US006204831B1

(12) United States Patent
Nishioka et al.

(10) Patent No.: US 6,204,831 B1
(45) Date of Patent: Mar. 20, 2001

(54) LIQUID CRYSTAL DISPLAY DRIVER

(75) Inventors: Nobuyuki Nishioka, Kanazawa; Osamu Yamamoto, Matto, both of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/130,453

(22) Filed: Aug. 7, 1998

(30) Foreign Application Priority Data

Aug. 8, 1997 (JP) ..... 9-213766

(51) Int. Cl.[7] ..... G09G 3/12; G09G 3/16; G09G 3/18

(52) U.S. Cl. ..... 345/53; 345/33; 345/34; 345/48; 345/50; 345/51; 345/53

(58) Field of Search ..... 345/33, 34, 48, 345/50, 51, 53

(56) References Cited

U.S. PATENT DOCUMENTS 4,981,339 1/1991 Nishimura .

6,031,510 * 2/2000 Drake et al. ..... 345/53

FOREIGN PATENT DOCUMENTS 7-44137 2/1995 (JP) .

* cited by examiner

*Primary Examiner*—Richard A. Hjerpe
*Assistant Examiner*—Benjamin D. Bowers
(74) *Attorney, Agent, or Firm*—Parkhurst & Wendel, L.L.P.

(57) ABSTRACT

A liquid crystal display driver has a system of driving a plurality of segments with 1/n duty binary voltages. In the system, one frame period has the following three sub-periods; the first sub-period, where the line sequential driving is performed, the second sub-period, where adjustment is made on the segment voltage dispersion which occurs depending on display patterns, and the third sub-period, which is at the other time span than the first and the second sub-periods in the same frame period, where the potentials of the common signals and those of the segment signals are identical. With this driving method, constant Von/Voff ratio is obtained, and the contrast dispersion and crosstalk, which occur depending on a display pattern, are mostly eliminated. Then a good display quality is obtainable, and also the effective values of the voltages applied to the liquid crystal, are adjustable irrespective to the power source voltage.

4 Claims, 8 Drawing Sheets

| | S1 | S2 | S3 | S4 |
|---|---|---|---|---|
| C1 | 1 | 0 | 0 | X |
| C2 | X | 1 | 1 | 1 |

| | S1 | S2 | S3 |
|---|---|---|---|
| C1 | 0 | 0 | X |
| C2 | 1 | 1 | 1 |
| C3 | X | 0 | 1 |

11, 12· · · SEGMENT
C1, C2· · · COMMON ELECTRODE
S1, S2, S3, S4· · · SEGMENT ELECTRODE 21, 22· · · SEGMENT
C1, C2, C3 · · ·
S1, S2, S3 · · · COMMON ELECTRODE
SEGMENT ELECTRODE

LIQUID CRYSTAL DISPLAY DRIVER

FIELD OF THE INVENTION

The present invention relates to a driving system of a relatively small simple matrix liquid crystal display (hereinafter abbreviated LCD) for remote control devices, electronic calculators, etc.

BACKGROUND OF THE INVENTION

Recently a simple matrix LCD has been widely used for electronic calculators, electric home appliances such as radios and measuring equipment, etc. For application to these devices, it is desirable for the LCD to have less power consumption, less driving voltage, good contrast, less crosstalk, viz., less phenomenon of half-selected segments appearing like those selected because of potentials applied there, and yet less expensive.

A conventional simple matrix driving system for displaying a liquid crystal panel has been a multiplex system, viz., a system of a line sequential AC drive. The system has common electrodes and segment electrodes. The common voltage waveforms are applied to the common electrodes each in a manner of time division line sequences. The signal voltages are each applied to the segment electrodes. Then the selected points are displayed by the combination of these two types of the voltages. The system is widely adopted because less signal lines are needed for driving.

As is well known, electrolysis occurs when a direct current is continuously applied to the liquid crystal. Therefore, the mean value of the electric field applied to the liquid crystal during a certain period needs to be zero in order to prevent the electrolysis.

For obtaining a good display quality, the system described above adopts the system of applying a bias voltage for the proper setting of the effective values "Von" and "Voff", which are applied to the selected points (an active portion of the liquid crystal) and to the half-selected points (an inactive portion of the liquid crystal) respectively. The system needs three or more values of voltages, viz., voltages of a power source voltage level, zero potential and one or more values of an intermediate level. A popular example is ½ duty-½ bias or ⅓ duty-⅓ bias driving system.

On one hand it is necessary to apply the "Voff" voltages to the half-selected segments for the speed up of the response of the liquid crystal; on the other hand, the larger "Von/Voff" ratio is, the better the contrast is.

The following is an explanation of the example of ½ duty-½ bias or ⅓ duty-⅓ bias driving;

FIG. 4 shows the structural diagram of the liquid crystal display portion of ½ duty-½ bias with seven segments forming a numeric "8". The two common electrodes C1 and C2 are commonly coupled with each of the segments, and the four segment electrodes S1 through S4 are commonly coupled with each of the segments. The shaded segments in FIG. 4 are under driving.

FIG. 6 shows the common voltage waveforms of C1 and C2 of the conventional liquid crystal driving circuit 1 of FIG. 8(*a*). FIG. 6 also shows the segment voltage waveforms of S1 and S2 of the same circuit, and the voltage waveforms of the potential differences between the common electrode C1 and the segment electrodes S1 and S2. This ½ duty-½ bias common voltage waveforms have the three voltage levels of VDD, V1 and V2, and then, the segment voltage waveforms have the two voltage levels of VDD and V2. The liquid crystal driving circuit 1 gets these voltages from the voltage dividing circuit 2. The voltage dividing circuit 2, having voltage-dividing resistors shown in FIG. 9(*a*), generates the voltage levels of V1 and V2 by dividing the power source voltage VDD which comes from the power source 3. With a variable resistor Rv in FIG. 9(*a*), the potential levels between VDD and V2 are adjusted for the control of the display intensity.

From the voltage waveforms of FIG. 6, it is understood that, for example, the voltage of effective value $V1((1^2+2^2)/^{1/2}$ is applied between the common electrode C1 and the segment electrode S1. Then, the segment 11 between the common electrode C1 and the segment electrode S1 is driven because the voltage is higher than the threshold voltage for ON of the liquid crystal. Between the common electrode C1 and the segment electrode S2, the voltage of the effective value $V1(1^2/2)^{1/2}$ is applied. However, the segment 12 between the common electrode C1 and the segment electrode S2 is not driven because the voltage is lower than the threshold voltage for ON of the liquid crystal.

FIG. 5 shows structural diagrams of the liquid crystal display portion of ⅓ duty-⅓ bias with seven segments forming a numeric "8". The system has the common electrodes C1 through C3 which are commonly coupled with each of the segments, and the segment electrodes S1 through S3 which are commonly coupled with each of the segments. The shaded segments are under driving.

FIG. 7 shows the common voltage waveforms of the common electrodes C1 through C3 of the conventional liquid crystal driving circuit 4 of FIG. 8(*b*). FIG. 7 also shows the segment voltage waveforms of the segment electrodes S1 through S3 of the same circuit, and the voltage waveforms of the potential differences between the common electrodes C1, C2 and the segment electrodes S1, S3. These ⅓ duty-⅓ bias common voltage waveforms and the segment voltage waveforms have four voltage levels of VDD, V1, V2 and V3. The liquid crystal driving circuit 4 of FIG. 8(*b*)gets these voltages from a voltage dividing circuit 5. The voltage dividing circuit 5, having voltage-dividing resistors of FIG. 9(*b*), generates the voltage V1, V2 and V3 by dividing the power source voltage VDD from a power source 9. With a variable resistor Rv in FIG. 9(*b*), the potential levels between VDD and V3 are adjusted for control of a display intensity.

From the voltage waveforms of FIG. 7, for example, the voltage of the effective value $V1((1^2+1^2+1^2)/3)^{1/2}$ is applied between the common electrode C1 and the segment electrode S1. However, the segment 21 of FIG. 5 between the common electrode C1 and the segment electrode S1 is not driven because the effective value is lower than the threshold voltage for ON of the liquid crystal. Between the common electrode C2 and the segment electrode S3, the voltage of the effective value $V1((1^2+3^2+1^2)/3)^{1/2}$ is applied. Then, the segment 22 between the common electrode C2 and the segment electrode S3 is driven because the effective value is higher than the threshold voltage for ON of the liquid crystal.

As described above, the conventional driving system needs the control of three or more voltages. However, the digital circuits of microcomputer, gate array, etc. are operated on the binary basis of on-off. Therefore, it is practically difficult to adopt the direct control system for the digital circuits like microcomputer, gate array, etc., because a complicated structure is needed for the direct control of three or more voltages on the circuits.

The driving system described above receives a plurality of voltages, in some cases, from the divided voltages which are generated by dividing the power source voltage with the voltage dividing resistors. In these cases, the output impedance of the power source to the LCD depends on the voltage dividing resistors. Then, if the resistance values of the dividing resistors are increased for a purpose of low power consumption, the driving voltage waveforms are distorted by the resistance load and the capacitance of the liquid crystals. Since the capacitance is different by each segment, the display intensity of the selected segments differs by each segment. Then, the uniform contrast is not obtainable and also an uneven crosstalk occurs on the half-selected segments.

The digital circuits have come to be driven with lower and lower voltages and the microcomputers driven with less than two volts are now in use. However, the driving voltages are too low for the conventional liquid crystal driving system described above, so that the liquid crystal cannot be driven in a visible range without using a voltage boosting circuit.

In case of the conventional driving system described above, the display intensity is adjusted by changing the driving voltages using the variable resistor for instance. However, it is difficult to adjust the driving voltage values directly on the digital circuits.

Then, a binary voltage single power source multiplex driving system is proposed. And there is another proposal of binary voltage driving for obtaining a uniform contrast, that is, a frame period is divided into some timing periods and the contrast is adjusted at one of the timing periods.

However, an easier and more flexible contrast and display intensity adjustment system is desired.

On an LCD equipped relatively high voltage operated appliance, when binary voltage driving is made using the same power source, it is necessary to step down the voltages applied to the LCD by dividing the power source voltage using the variable resistor, for instance. Then, additional component parts are needed. Especially when the LCD is driven with the voltages divided by the variable resistor, like in the case of the bias driving system as described above, and the resistance value of the voltage dividing resistor is increased for the purpose of low power consumption, the driving waveforms are distorted by the resistance load and the capacitance of the segments. Then, the display intensity of the segments to be displayed differs by each segment. In such case, even if the contrast adjustment is made by the method described above, the uniform contrast is not obtainable, and in addition to that, the voltages applied to the half-selected segments becomes uneven and an uneven crosstalk occurs. Therefore, a better driving system is desired, with which the effective values of the voltages applied to the LCD are adjustable without occurrence of the above problems.

SUMMARY OF THE INVENTION

The present invention aims to provide a binary voltage simple matrix liquid crystal driving system which can easily and flexibly prevent a phenomenon that the applied voltages become uneven depending on a display pattern.

Note: The applied voltages (hereinafter referred to as the segment voltages) are generated by the potential difference between the common signals and the segment signals at the crossing points of the common electrodes and the segment electrodes.

And also the present invention aims to provide a system which makes it possible to adjust easily the effective values of voltages applied to the segments, even in the single power source driving, irrespectively to the power source voltages, without affecting the contrast, and keeping the "Von/Voff" ratio constant.

Then the system can eliminate most of the problematic phenomena which are liable to occur in the conventional system in regard to the contrast, the crosstalk and the display intensity.

The present invention, to achieve the above aims, is featured with a frame period which includes the following three sub-periods;

(a) the first sub-period; a selection period for on-off control of each segment by means of a line sequential scanning in a period of n pieces of an equal time span "t1", (b) the second sub-period; a segment voltage correction period to prevent for the segment voltages to become uneven depending on a display pattern, and it comprises N pieces of the time span "t1", (c) the third sub-period; an effective voltage adjusting period for the adjustment of the effective voltages without changing the "Von/Voff" ratio, and it is set at the other time span than the above (a) and (b) in the same frame period.

The present invention, having the structure described above, provides the liquid crystal driving system with a single power source, which can be directly controlled by a binary digital circuit, etc. The system achieves the constant "Von/Voff" ratio, less contrast dispersion, less uneven crosstalk, accordingly, a good display quality, and a controllability of the effective values of the voltages applied to the liquid crystal, viz., that of display intensity.

BRIEF DESCRIPTION OF THE DRAWINGS

FIG. 1(*b*) shows the matrix chart of the common signals and the segment signals which display a numeric "4" with seven segments.

FIG. 2(*b*) shows the matrix chart of the common signals and the segment signals which display a numeric "4" with seven segments.

FIG. 9(*b*) shows the same, but of ⅓ duty-⅓ bias driving.

DETAILED DESCRIPTION OF THE EXEMPLARY EMBODIMENTS

Embodiment 1

Figure 3A:
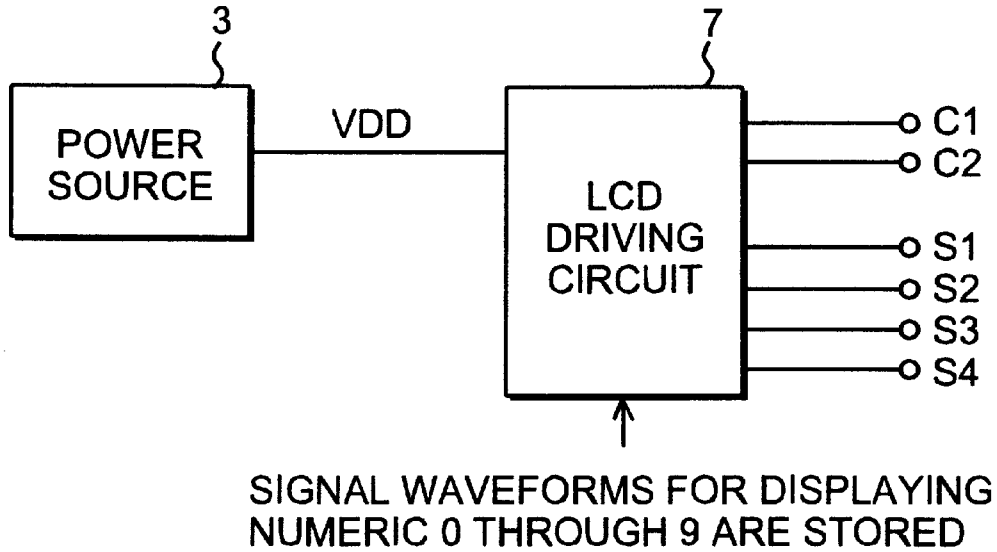
FIGS. 3(*a*) and (*b*) show the structural diagrams of the simple matrix liquid crystal driving circuits of the exemplary embodiment 1 and 2 respectively.
Figure 3B:
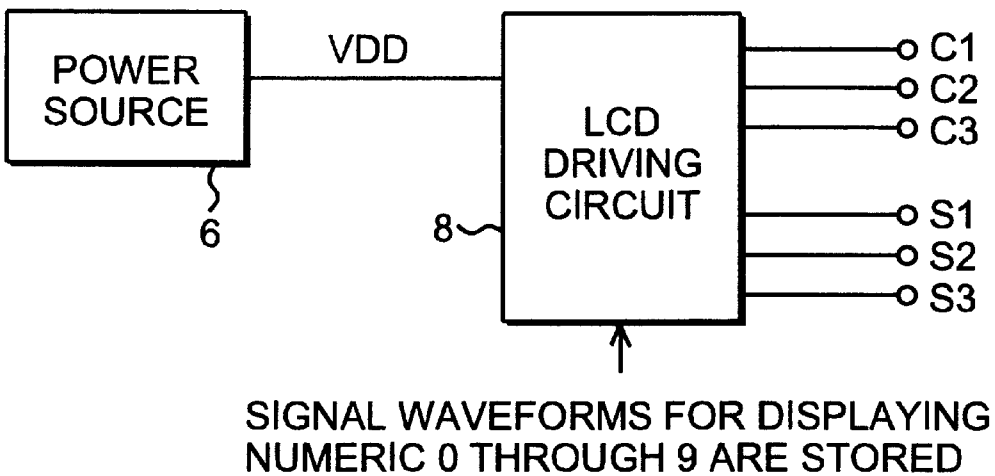
Figure 4A:
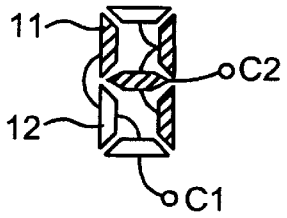
FIGS. 4(*a*) and (*b*) show the structural diagrams of the ½ duty liquid crystal display portions with seven segments forming a numeric "8".
Figure 4B:
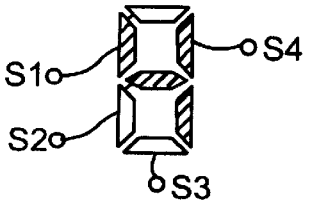

The followings are the explanations on ½ duty simple matrix liquid crystal driving system of FIG. 3(*a*), with seven segments forming a numeric "8" of FIG. 4.

Figures 1A, 1B:
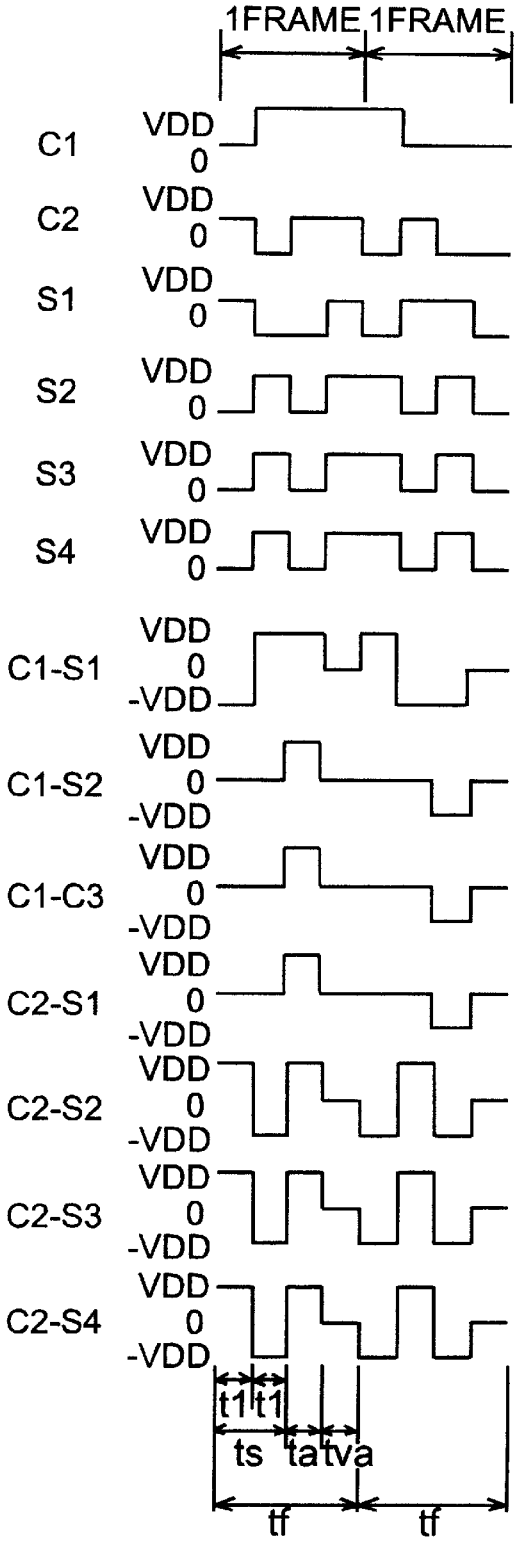
FIG. 1(*a*) shows the liquid crystal driving waveforms, which display seven segments in ½ duty simple matrix driving system of the exemplary embodiment 1.

FIG. 1(*a*) shows the following;

(1) C1 and C2 are the voltage waveforms of the common signals applied to the common electrodes C1 and C2 of FIG. 4 from the liquid crystal driving circuit 7 of FIG. 3(*a*).

(2) S1 through S4 are the voltage waveforms of the segment signals applied to the segment electrodes S1 through S4 of FIG. 4 from the liquid crystal driving circuit 7 of FIG. 3(*a*).

(3) C1-S1 through C2-S4 are the segment voltage waveforms applied to each segment by the potential difference between the common signals and the segment signals.

For the driving voltage of the liquid crystal driving circuit 7, a power source voltage VDD of the power source 3 is used.

The common signals of the common electrodes C1 and C2 of FIG. 1, during the selection period "ts", make a line sequential driving, viz., the signals comprising two potentials of the power source voltage VDD and zero potential make the scanning of "t1" by "t1" sequentially. The potential zero periods of the electrodes C1 and C2 are the selection periods of each. The segment electrodes select, at the potential VDD, the ON of the segments at the crossing points of the segment electrodes and the common electrodes. After that, the following two periods are set; a correction period "ta" where the effective values of voltages applied to each segment are adjusted to become even among each segment, and an effective voltage values adjusting period "tva", where the potentials of the effective voltage values are adjusted.

At the correction period "ta", the adjustment is made by the method of making the potential of specified segment signals zero during the period, so that the effective voltage values become even and equal among all of the selected segments and the half-selected segments respectively.

At effective voltage adjustment period "tva", the effective voltage values are adjusted by the method of making the potentials of all of the common signals and segment signals equal during the period, so that the effective voltage values can be adjusted without using a variable resistor. The principle is described in the embodiment 2.

During the period when the common signals C1 and C2 of FIG. 1 proceed "t1" by "t1"the segment signals S1 through S4 change to the potentials of VDD or 0 according to the driving segments.

Above are the explanation on the first frame period, viz., the first "tf" in FIG. 1(*a*). In the next frame period, the driving is to be made reversely so that the mean value of the direct current voltages in certain span of time becomes zero in order to prevent the electrolysis of the liquid crystal. Therefore, in the second frame, the driving is made based on the principle of replacing the potentials 0 with VDD. Namely, the driving is made in a manner of a cycle of the combination of the two frame periods.

For the help of the understanding, FIG. 1(*b*) is prepared, which shows the matrix of the combination of the common electrodes and the segment electrodes. When a numeric "4" is displayed with the shadowed segments of FIG. 4(*a*) and (b), the segments with "1" show the selected, segment with "0" show the half-selected and the segments with "X" show irrelevant to the selection.

In FIG. 1, the segment voltages of the waveforms of C1-S1, C2-S2, C2-C3 and C2-S4 are applied to the selected segments and the effective value is $VDD(3/4)^{1/2}$. To the half-selected segments, the segment voltages of the waveforms C1-S2, C1-S3 and C2-S1 are applied and the effective value is $VDD(1/4)^{1/2}$.

For the adjustment of the effective values of the segment voltages, the segment signals S1 through S4 are set to zero potential during the segment voltage correction period "ta" in the first frame. Then, the selected segment voltage waveforms C1-S1, C2-S2, C2-S3 and the half-selected segment voltage waveforms C1-S2, C1-S3 and C2-S1 each have the constant value of; $Von=VDD(3/4)^{1/2}$ and $Voff\text{-}VDD(1/4)^{1/2}$ respectively.

Accordingly, both "Von" and "Voff" values do not become uneven at any display pattern, then the effect of the uniform contrast is obtainable.

As described above, the driving system provides the following effects:

(a) The uniform contrast.

(b) The direct control on the binary digital circuits because of no need of three or more voltages.

(c) The uniform contrast and less cross talk. The effective voltage values are adjustable, even when the driving is made directly with the power source voltage VDD of the power source 3. Therefore the output impedance of the power source can be made small, and also it is unnecessary to get the segment signals and common signals through the voltage dividing resistors. Then the contrast dispersion and the uneven crosstalk are mostly eliminated, since the driving waveforms distortion, which is caused by the resistance load and each different capacitance of the segments, hardly occurs.

(d) The curtailment of production cost is obtained, because the variable resistor, etc. become unnecessary, since the effective value of the driving voltages are adjustable without them.

Embodiment 2

Figure 5A:
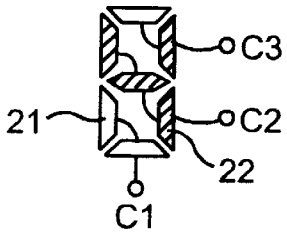
FIGS. 5(*a*) and (*b*) show the structural diagrams of ⅓ duty liquid crystal display portions with seven segments forming a numeric "8".
Figure 5B:
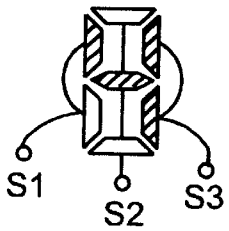
Figure 6:
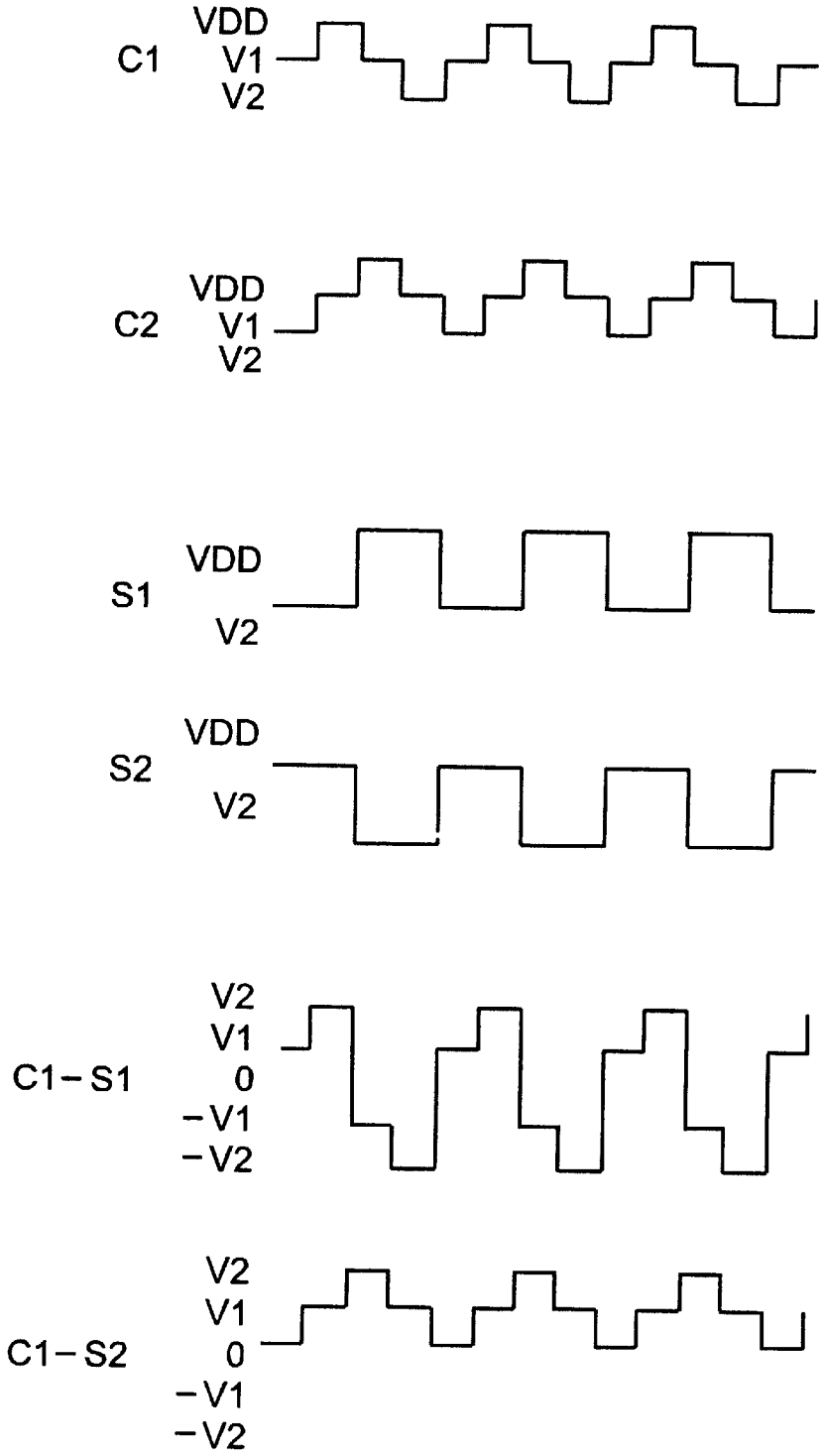
FIG. 6 PRIOR ART
FIG. 6 shows the liquid crystal driving waveforms for displaying seven segments with a conventional ½ duty-½ bias driving system.
Figure 7:
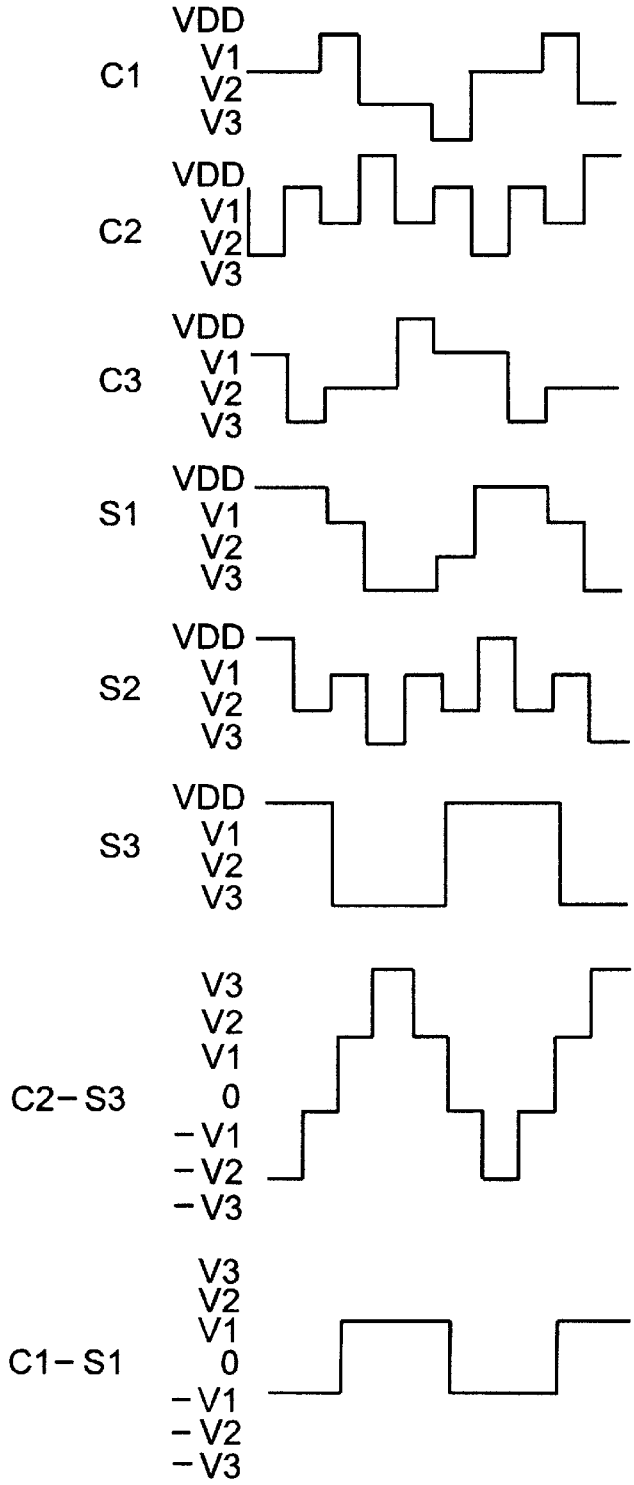
FIG. 7 PRIOR ART
FIG. 7 shows the liquid crystal driving waveforms for displaying the seven segments with the conventional ⅓ duty-⅓ bias driving system.
Figure 8A:
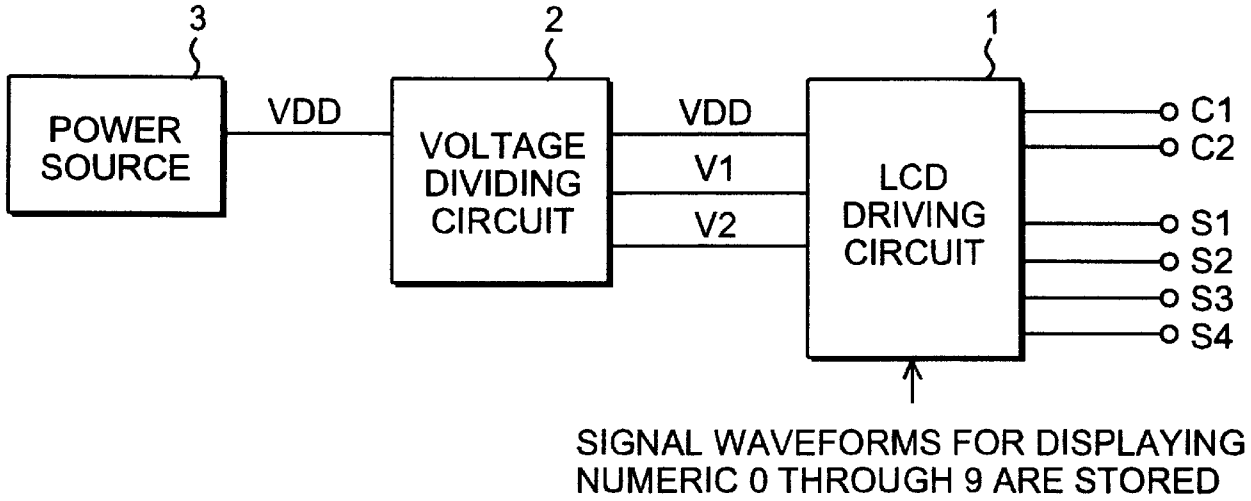
FIG. 8(a) PRIOR ART
FIGS. 8(*a*) and (*b*) show the structural diagrams of the conventional simple matrix liquid crystal driving circuits.
Figure 8B:
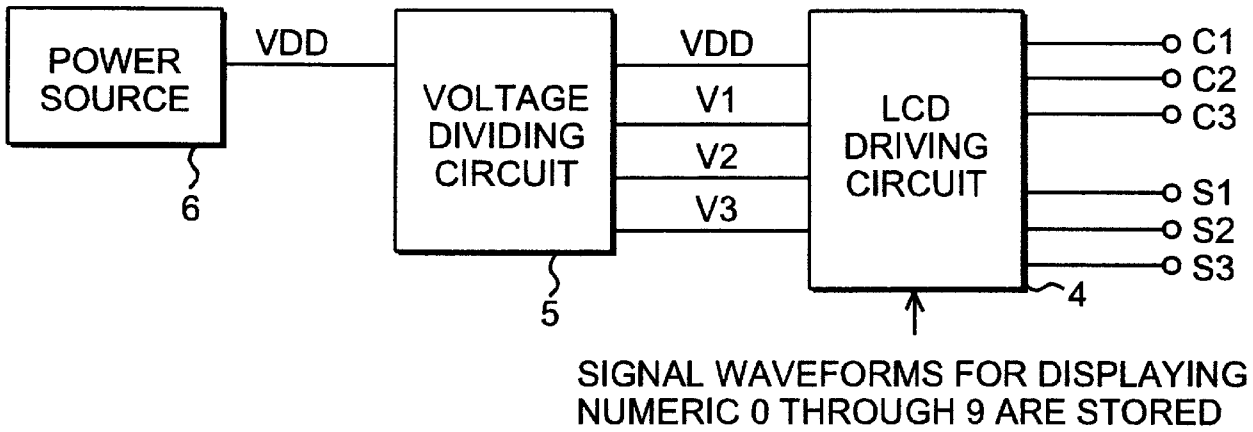
FIG. 8(b) PRIOR ART
Figure 9A:
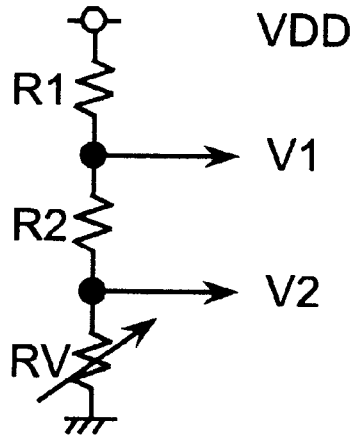
FIG. 9(a) PRIOR ART
FIG. 9(*a*) shows the circuit diagram to generate the divided voltages by the dividing resistors for obtaining the waveforms of ½ duty-½ bias driving.
Figure 9B:
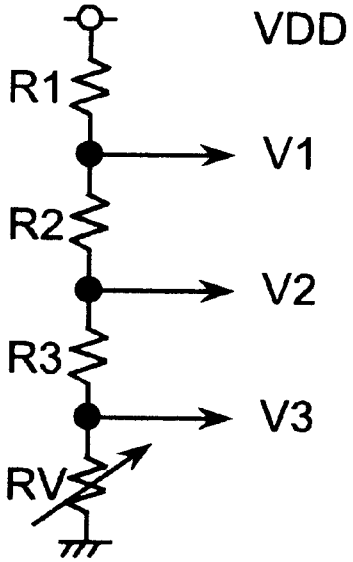
FIG. 9(b) PRIOR ART

The following is the explanation on ⅓ duty simple matrix liquid crystal driving system of FIG. 3(*b*), with seven segments forming a numeric "8" of FIG. 5.

Figures 2A, 2B:
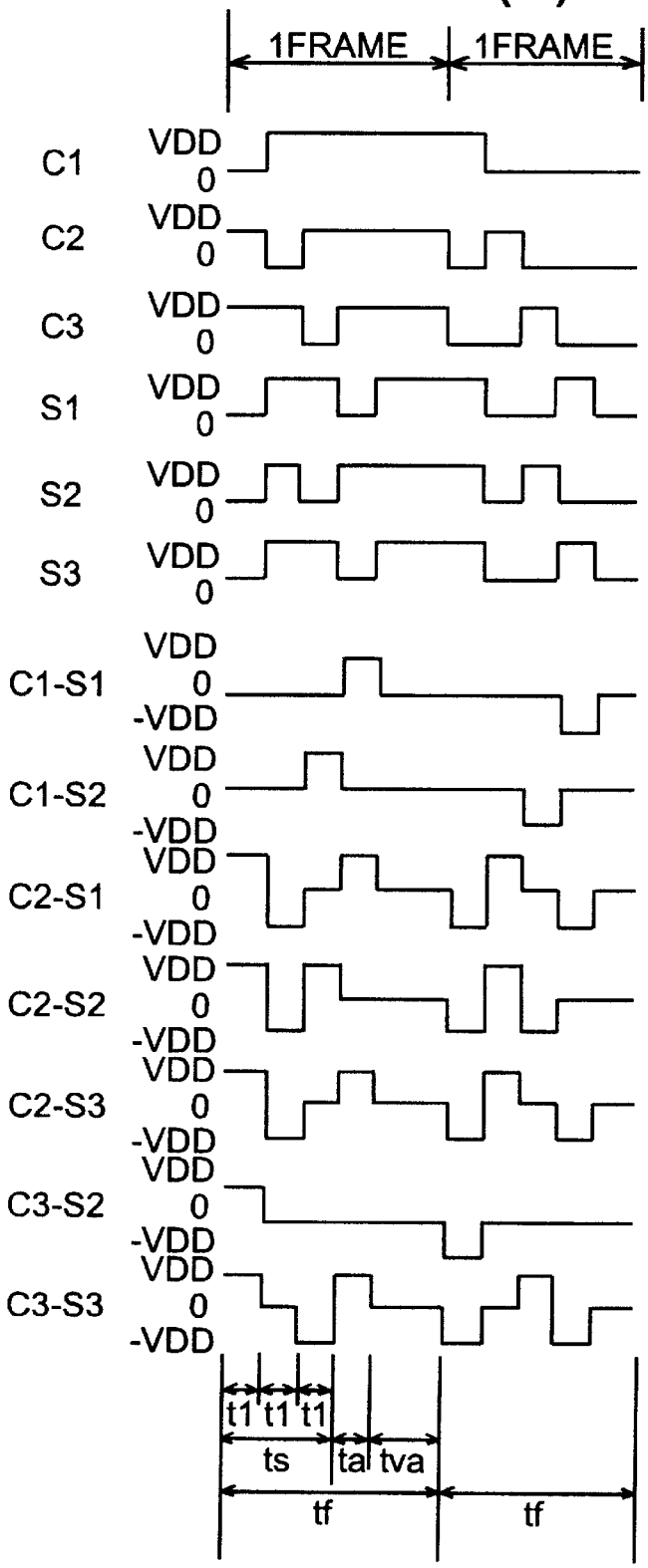
FIG. 2(*a*) shows the liquid crystal driving waveforms, which display seven segments in ⅓ duty simple matrix driving system of the exemplary embodiment 2.

FIG. 2(*a*) shows the following;

(1) C1 through C3 are the driving voltage waveforms of the common signals applied to the common electrodes C1 through C3 of FIG. 5, and the applied signals comes from the driving circuit 8 of FIG. 3(*b*), (2) S1 through S3 are the driving voltage waveforms of the segment signals applied to the segment electrodes S1 through S3 of FIG. 5, and the applied signals comes from the driving circuit 8 of FIG. 3(*b*), (3) C1-S1 through C3-S3 are the segment voltage waveforms applied by the potential differences between the common signals and the segment signals.

For the driving voltage of the liquid crystal driving circuit 8, the power source voltage VDD of the power source 6 is used.

For the help of the understanding, FIG. 2(*b*) is prepared, which shows the matrix of the combination of the common electrodes and the segment electrodes. When a numeric "4" is displayed with the shadowed segments of FIG. 5(*a*) and (*b*), the segment with "1" shows the selected, segment with "0" shows the half-selected and segment with "X" shows irrelevant to the selection.

FIG. 2 shows that the segment voltages C2-S1, C2-S2, C2-S3 and C3-S3 are applied to the selected segments, and the effective value is $VDD(3/6)^{1/2}$, and then the segment voltages C1-S1, C1-S2 and C3-S2 are applied to the half-selected segments, and the effective value is $VDD(1/6)^{1/2}$.

In the embodiment 2, for the adjustment of the effective values of the segment voltages, the segment signals S1 and S3 are set to zero potential during the segment voltages adjusting period "ta" of the first frame. Then, the effective value of the segment voltages of the selected segment voltages C2-S1, C2-S2, C2-S3 and C3-S3 are adjusted to become constant, viz., $Von=VDD(3/6)^{1/2}$, and then, the effective values of the half-selected segments voltages C1-S1 and C1-S2 are also adjusted to become constant, viz., $Voff=VDD(1/6)^{1/2}$. Accordingly, the "Von" and the "Voff" values are constant on any display pattern, and then, the uniform contrast is obtainable. In the next frame period, due to the AC driving, the driving is made based on the principle of replacing the potentials 0 with VDD and the same effects are obtainable.

In the embodiment 2, the effective voltage adjusting period "tva" is set to "2ts" which is different from the embodiment 1. Then, the denominator of the effective values of the segment voltages is adjusted to $(6)^{1/2}$. Depending on the relation between the power source voltage VDD and characteristic of the liquid crystal, the effective values of the segment voltages can be changed by changing the span of the period of "tva". For instance, when tva=t1 and tva=0, the denominators of the effective values of the segment voltages are $(5)^{1/2}$ and $(4)^{1/2}$ respectively, and then large effective values of the segment voltages are obtainable. If the effective voltage adjusting period "tva" is set larger, the denominator of the effective value of the segment voltages becomes larger, then smaller effective values of the segment voltages are obtainable from the same power source voltage. Thus, the LCD is directly controllable using the power source of which voltage value is relatively large against the allowable voltage value of the LCD, so that the flexible application becomes available.

The "Von/Voff" ratio determines the contrast and when the ratio is larger, the better contrast is obtainable. When the effective values of the segment voltages are adjusted at the effective voltage adjustment period "tva", only the denominator of the effective values of the segment voltages changes and no influence to the other parameters, so that, in the embodiment 2, the ratio is the following constant value;

$$Von/Voff=VDD(3/6)^{1/2}/VDD(1/6)^{1/2}=(3/1)^{1/2}.$$

In the embodiment 1, in the same manner, the ratio is constant and the value is;

$$Von/Voff=(3/1)^{1/2}.$$

As described above, in the embodiment 2 of ⅓ duty driving, like in the case of the embodiment 1, the control for obtaining the uniform contrast is possible by the correction period "ta". Then the direct control by a binary digital circuit is possible, because even if the power source voltage is applied to the common signals and to the segment signals, the effective values of the segment voltages are adjustable, and the dividing resistors become unnecessary. Then the contrast dispersion and the uneven crosstalk are eliminated mostly.

The explanation above is made assuming that the effective voltage adjusting period "tva" is the integral multiple of "t1" which is the unit of the selection period "ts". However, even when "tva" is not the period of the integral multiple of "t1"it is obvious from the explanations of the embodiments, that the driving voltages are adjustable without the influence to the "Von/Voff" ratio. It is also obvious that even the elimination of this period is one of the adjusting methods.

It is also obvious, from the above explanation, that the same effect on the effective voltage values adjustment is obtainable, even when the period, where the potentials of the common signals and the segment signals are made identical for the adjustment of the effective voltage values, is set at any time span in the frame period.

The present invention, as described above, provides the following;

(a) At any display pattern, the applied effective voltage "Von" for the selected segments and "Voff" for the half-selected segments can be made constant respectively, and also the constant "Von/Voff" ratio is obtainable.

(b) Without affecting to the "Von/Voff" ratio, the effective values of the driving voltages are adjustable. Then, keeping the contrast stable and uniform, above described effective values are adjustable.

(c) When a relatively high voltage from the appliance is applied to the liquid crystal, since the effective driving values are adjustable without dividing the power source voltage with the voltage dividing resistors, the influence from the resistance load and the capacitance of the liquid crystal is avoidable. Then, the distortion of the driving voltage waveforms hardly occurs and "Von " and "Voff", which are made constant at the second sub-period "ta" in the frame period, are not made uneven at any portion of the segments, so that uneven contrast and crosstalk also hardly occurs.

As a summary, a good display quality liquid crystal driving system of good contrast and less crosstalk is obtainable from the following two effects of the embodiments:

(1) The first effect; "Von" and "Voff" can be kept constant by the correction period "ta" which is the second sub-period in the frame period.

(2) The second effect; the effective values of the driving voltage waveforms can be changed by the effective voltage adjusting period "tva", which is the third sub-period in the frame period, without depending on the power source voltage and without occurrence of the distortion of the driving waveforms.

What is claimed is:

1. A method of driving an LCD (Liquid Crystal Display) where a plurality of segments are driven by a 1/n duty binary voltage driving system, a predetermined period including:

(a) a first sub-period where common and segment signals perform a line sequential driving, (b) a second sub-period where dispersion of a voltage applied to the segments produced depending on a display pattern is adjusted, (c) a third sub-period which is a remaining period of the predetermined period where said first and second sub-periods already exist, wherein electric potential of said common and segment signals are identical.

2. The method of driving an LCD as defined in claim 1, wherein said third sub-period has a zero time span.

3. A method of driving an LCD (Liquid Crystal Display) where a plurality of segments are driven by a 1/n duty binary voltage driving system, comprising a predetermined period including a sub-period in which electric potential of common and segment signals are identical, and effective voltage values applied to all said segments are adjusted by changing the span of said sub-period.

4. The method of driving an LCD as defined in a claim 1, wherein said display pattern comprises a plurality of electrodes forming a numeric "8".

* * * * *